United States Patent [19]

Herpfer

[11] 4,135,686

[45] Jan. 23, 1979

[54] DEVICE FOR STARTING ROCKET-DRIVEN MISSILES

[75] Inventor: Eugen Herpfer, Markdorf, Germany

[73] Assignee: Dornier GmbH, Germany

[21] Appl. No.: 620,797

[22] Filed: Oct. 8, 1975

[30] Foreign Application Priority Data

Nov. 2, 1974 [DE] Fed. Rep. of Germany ..... 2452053

[51] Int. Cl.[2] ..... F42B 13/32

[52] U.S. Cl. ..... 244/3.27

[58] Field of Search ..... 244/3.27; 102/4, 49.4

[56] References Cited

U.S. PATENT DOCUMENTS 3,004,489 10/1961 Griffith et al. ..... 244/3.27

3,158,100 11/1964 Finley ..... 102/49.4

3,228,634 1/1966 Chakoian et al. ..... 102/4

*Primary Examiner*—Samuel Feinberg

*Attorney, Agent, or Firm*—James E. Bryan

[57] ABSTRACT

This invention relates to a device for starting a rocket-driven missile whose filght course is directed opposite the flight course of a carrier aircraft, which comprises aerodynamically-acting braking means adapted to act upon said rocket-driven missile, said braking means being adapted to be extended from a position of low resistance to a position of higher resistance, and means for separating said braking means from said rocket-driven missile upon completion of the braking operation.

3 Claims, 8 Drawing Figures

FIG. 2
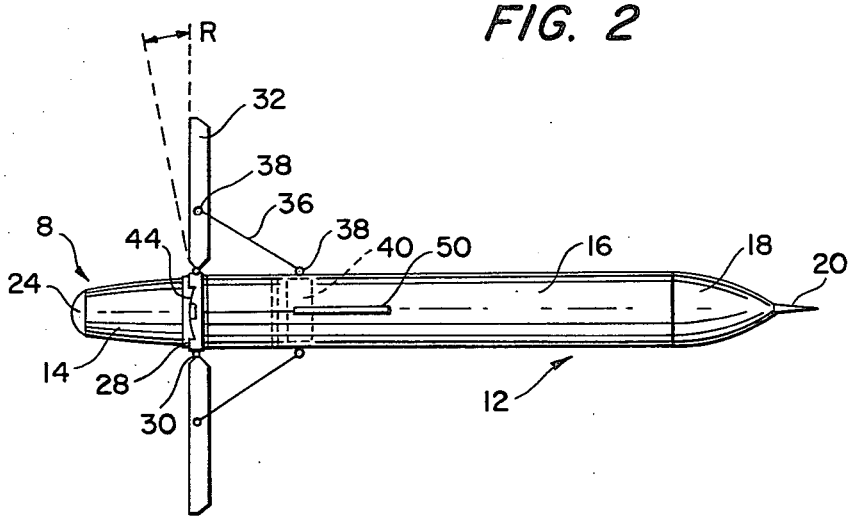
FIG. 3
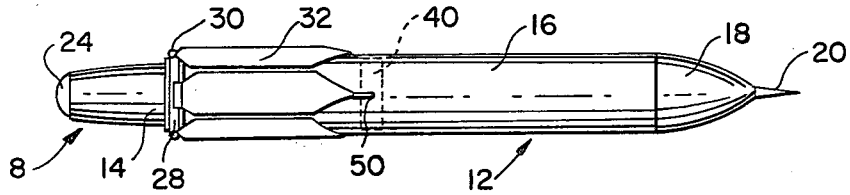
FIG. 4
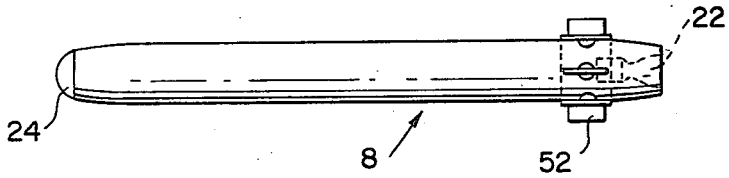
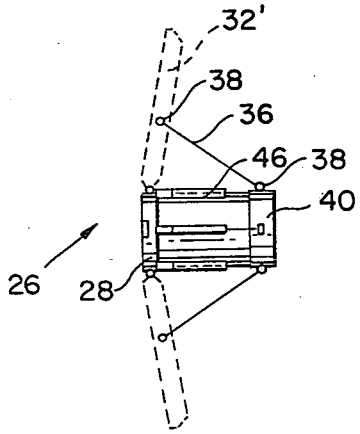
FIG. 5

DEVICE FOR STARTING ROCKET-DRIVEN MISSILES

The present invention relates to a device for starting rocket-driven missiles whose direction of flight is directed opposite the direction of flight of its carrier aircraft moving at a high air speed.

For the purpose of successfully warding off, or repulsing attacks from the rear semi-infinite body of fighter aircraft, these aircraft must be adapted to cause guided missiles to travel opposite their direction of flight. Towards this end, it is necessary that the guided weapon, after separation thereof, from the carrier, flies aerodynamically stably within limits in order that the seeker or searching head will not lose the previously located target.

A general problem of guided weapons which are caused to travel opposite the direction of flight of their carrier is that their initial speed is significantly lower than that of the carrier airplane, and — due to the relative movement between the carrier aircraft and the surrounding air — the missiles are subject to an air flow from the rear. Unless specific measures are taken, such as, for example, the generation of a follower flow into which the missile is launched, or a spin stabilization, the missile becomes unstable immediately after the start, begins to tumble, and probably will lose the target.

It already has been proposed to produce a follower flow by devices acting upon the flow, into which follower flow the missile is launched. This follower flow has the effect that an air flow will be produced at the missile from its tip also during the starting phase (German Patent Application No. P 24 28 402.4).

Further known is a starting device for rockets having a course of flight opposite the course of flight of the carrier, in which device the missile within a carrier obtains a moment of momentum movement prior to launching and is started in a manner such as to be stabilized against twist (U.S. Pat. No. 2,938,430).

Additionally known is a method for starting a reaction-propelled missile from a rapidly forwardly moving carrier approximately opposite the direction of movement thereof. In this known method, an additional mass is applied to the missile for the purpose of changing the position of the center of gravity with respect to the pressure point in order to effect that the missile being subjected to a flow from the rear remains stable. The additional mass in the form of a starting rocket is ignited during the start and brakes the missile in its direction of movement with the carrier. At that time the center of gravity travels in the direction of the missile tip. During the braking of the missile to zero speed, the additional mass or braking rocket is burned out and is dropped. Then the propulsion unit of the missile is ignited, in the known method, and the intended flight movement is initiated so that the missile accordingly will be subjected to flow from the front (German Offenlegungsschrift No. 2,143,689).

Finally, also known is a rocket starting device which operates with the aid of a guideway or track for the missile, this track being positioned in the course of flight. The track must have a relatively long length. The track serves for guiding the missile during its accelerating phase until it is subjected to flow from the front, for the purpose of eliminating the above-mentioned instability.

It is the object of the present invention to provide a device by means of which a so-called backwardly-running missile can be fired from a high speed carrier airplane as quickly as possible into its flight path. It is further intended that the missile, during the starting phase thereof, fly approximately stably in order that the seeker or searching head be adapted to track a target picked up. The device is intended to be as simple as possible.

This object is obtained, in accordance with the present invention, in that, for the retardation of the flying speed of the missile in the direction of flight of its carrier airplane, an aerodynamically-acting braking device is provided which acts upon the missile and which is adapted to be extended from a low resistance position into a position effecting resistance, and in that the braking device is separable from the missile upon the completion of the braking operation.

Achieved with the device provided by the present invention is that the start of the missile is rendered possible even at a vary high forward speed of the carrier airplane, and, for the purpose of braking the so-called return flight speed of the missile, essentially only an aerodynamically-acting braking system is used, and not the rocket engine. This results in a saving of the propulsive charge which saved portion may be employed, for example, for increasing the range of the missile. Furthermore, after the target pickup and the separation from the carrier airplane, the missile can operate completely autonomously according to the so-called "fire and forget" principle. It is also a special advantage of the inventive device that the braking device may be subsequently installed in already existing carrier airplanes at low cost.

The construction may be so made, according to the present invention, and in a special embodiment thereof, that a receiving container is mounted at the carrier airplane for receiving the missile, that the receiving container together with the missile is arranged so as to be separate or detachable from the carrier airplane, and that the receiving container carries the braking device. The special advantage of this construction is that the braking device is mounted at the receiving container, and therefore no specific means need be provided for detaching the braking device. When the propulsion unit of the missile is ignited, the receiving container with the extended braking device is automatically left behind. The support of the jet of the rocket engine of the missile at the receiving container acts as an aid for the start of the aircraft.

Two embodiments of the present invention are illustrated in the accompaying drawings, wherein FIG. 1 is a side view of a carrier airplane in conjunction with a missile which is carried in a receiving container, and of the missile in conjunction with the receiving container and the braking device in the released position thereof;

FIG. 2 illustrates the receiving container in conjunction with the missile and extended braking flaps of the braking device;

FIG. 3 illustrates the receiving container in conjunction with the missile, with the braking flaps of the braking device being secured in the retracted low resistance position thereof;

FIG. 4 illustrates the aircraft without the receiving container;

FIG. 5 is a schematic view of the braking device which is directly mounted at the missile;

Figure 1:
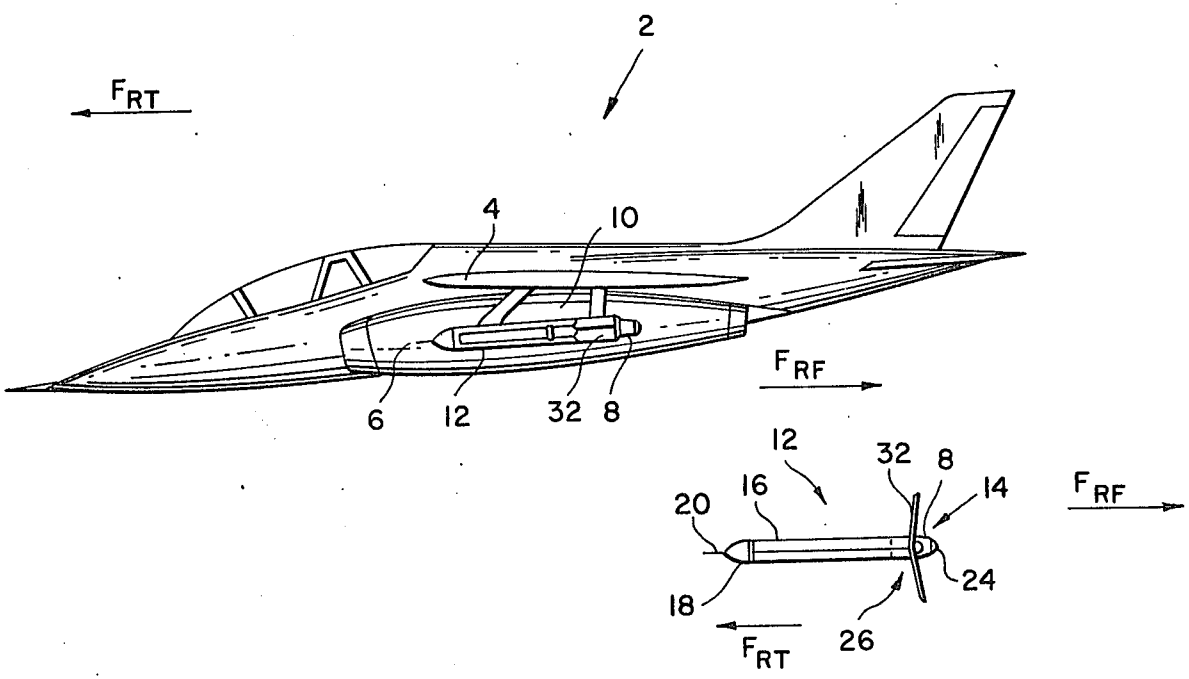
FIG. 1 illustrates as one of the embodiments of the present invention a carrier airplane which carries one or several missiles in conjunction with one or more starting containers.

In FIG. 1, reference numeral 2 identifies the carrier airplane, reference numeral 4 identifies the wings thereof, and reference numeral 6 identifies the propulsion unit. It is intended that this be a carrier airplane which flies at high speed and carries rocket-driven missiles 8 which are adapted to be employed to ward of approaching enemy projectiles or missiles. For this purpose there are mounted, for example at the wing pylons 10, and suspended thereon, the missiles 8 with the intermediary action of the receiving containers 12. The suspension is constructed in a conventional manner and comprises a releasing means which is also constructed in known manner. The type of the suspension and the releasing means therefore have not been illustrated herein, for purposes of simplification.

The missiles 8 are housed with their longitudinal axes approximately parallel to the longitudinal axis of the carrier airplane 2 and point with their jet discharge nozzles 22 (FIG. 4) in the direction of flight $F_{RT}$ of the carrier airplane 2, and hence with the missile tips 14 opposite this direction of flight $F_{RT}$, namely in the direction $F_{RF}$.

As has been already described hereinabove, the receiving container 12 is detachably mounted at the pylon 10 by way of a suspension (not shown). The receiving container 12 is composed of a flow-favorable tubular receiving part 16 which serves for receiving the missile 8. Added on at the end thereof pointing in the direction of flight $F_{RT}$ for the purpose of attaining a low resistance flow about the receiving container 12 is a nose portion or headpiece 18 being ogival in shape. The nose portion or headpiece 18 carries a dynamic pressure sonde 20 which, with its measuring opening, points in the direction of flight $F_{RT}$ of the carrier airplane. The sonde 20 controls switching means (not shown) which are actuatable in dependence upon the dynamic pressure measured, as will be further explained hereinbelow. At the opposite end, the receiving container 12 is open so that the nose of the missile 8 is exposed.

The missile 8 itself comprises a rocket engine, an ignition device, and a jet discharge nozzle 22, the latter being used also or the thrust vector control in known manner. The missile tip 14 is equipped with a seeker or searching head 24 and holds the picked-up target autonomously in connection with the aforementioned thrust vector control, as is also known.

As is apparent particularly from FIGS. 2 to 6, a braking device 26 is mounted at the receiving container 12. This device 26 comprises a carrier ring 28 which outwardly grips the receiving part 16 and is secured thereto. The carrier ring 28 includes the hinges 30 whose axes extend transversely to the longitudinal axis of the receiving container 12, and against which there are foldably mounted a plurality of braking flaps 32 uniformly distributed around the circumference. These braking flaps 32 are constructed arched or bent and are so arranged that with the concave surface thereof they point against the flow. The curvature of the braking flaps 32 is so chosen that these flaps 32, when in their inoperative position folded against the receiving part 16 (FIG. 3), will surround or envelop the receiving part 16 in a low resistance fashion. The braking flaps 32 are articulately connected by way of hold-back rods 36, by means of hinges 38, with a synchronous ring 40. The synchronous ring 40 is axially movable by means of the guides 50 at the receiving container 12. Provided for the positioning of the synchronous ring 40 corresponding to the maximal extended position of the braking flaps 32 is a stop 42 at the container 12. Further at the container 12 is a catch 44 which locks the braking flaps 32 in the braking position thereof. Inserted between the synchronous ring 40 and the carrier ring 28 are the hydraulically-acting damping members 46 which prevent a sudden opening movement of the braking flaps 32 (FIG. 5). It is additionally provided that in the closed position springs constantly act upon the braking flaps 32 in the sense of an opening movement. The braking flaps 32 are lifted off the container surface by the springs to such an extent that the further opening operation is automatically effected by the dynamic pressure acting upon the flaps 32 up to the maximal extended position. The synchronous ring 40 moves on the guides 50 at the receiving container 12. As is apparent from FIG. 2, it may be of advantage for the stabilization of the missile 8 that the braking flaps 32 in the final extended position thereof are positioned inclined against the radial line R in the direction of the container rear 48, as has been indicated in phantom.

Further mounted at the missile 8 are the stabilizer surfaces 52, namely in the area of the rear of the missile 8. These surfaces 52 are pivotal about axes parallel to the longitudinal missile axis and are urged by means of prestressed springs (not shown herein) into the extended position (FIG. 4) and held in this position. As a result thereof, they occupy less room radially in the container 12, in the folded-in position.

Figure 6:
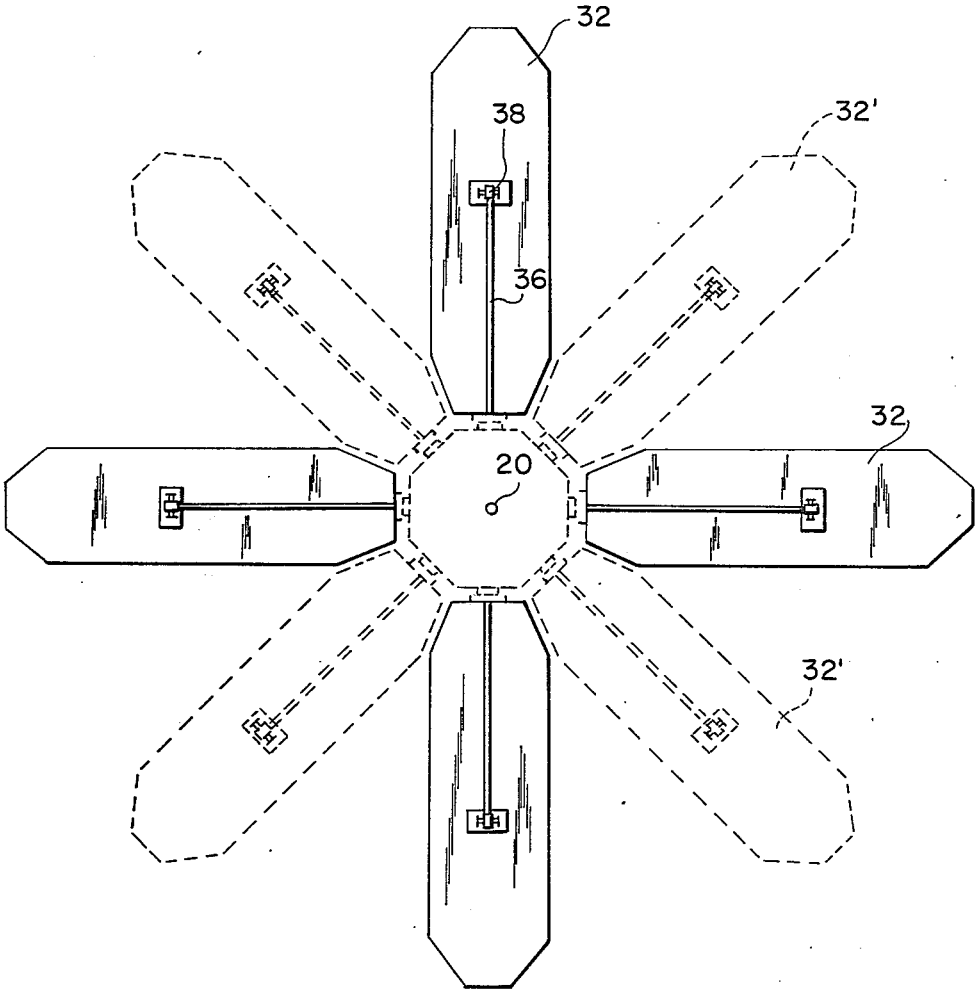
FIG. 6 illustrates — in a view toward the tip of the receiving container — two systems of braking flaps.

As shown in FIG. 6, eight braking flaps are foldably arranged in one embodiment at the receiving container 12. The provision is thereby so made that four of the braking flaps 32 are uniformly distributed around the circumference of the receiving container 12, while the other four braking flaps 32' are inserted in the gaps formed by the dimensions of the braking flaps 32. The extension of the flaps 32 and 32' is carried out in two stages. In the first stage, the flaps 32 are extended, and subsequently in the second stage the flaps 32' are extended in order to avoid overloading of the braking device, and in order to be able to simultaneously achieve a shortening of the braking time.

In the unlocking of the braking flaps 32 and 32', a guard ring (not shown) is blown off by known pyrotechnical means and the braking flaps 32 and 32' are freed for opening.

In another embodiment, according to FIG. 5, it is provided that the braking device 26 may be mounted directly at the missile 8 without the use of a receiving container 12. It is necessary in this case that the braking device as a whole can be dropped after the braking of the missile 8 has been accomplished. Toward this end the carrier ring 28 and the synchronous ring 40 are formed by two half rings (not shown) which are interlocked by way of a safety breaking point connection and are clamped to and guided at the missile 8. The safety connections contain known pyrotechnical means, such as bolts or the like adapted to be blown off. The detonation of the explosive charges may be effected with the intermediate action of a dynamic pressure sensor 20, as has been described above. When the dynamic pressure falls below a specific limit value, the detonation of the pyrotechnical means is effected.

The operation of the braking device according to the two aforedescribed embodiments is as follows:

In flight, the missile 8 is housed within the receiving container 12 and locked. The braking device 26 is in the retracted position thereof, (FIG. 3), i.e., the brake flaps 32 and 32' rest against the container 12.

Figure 8:
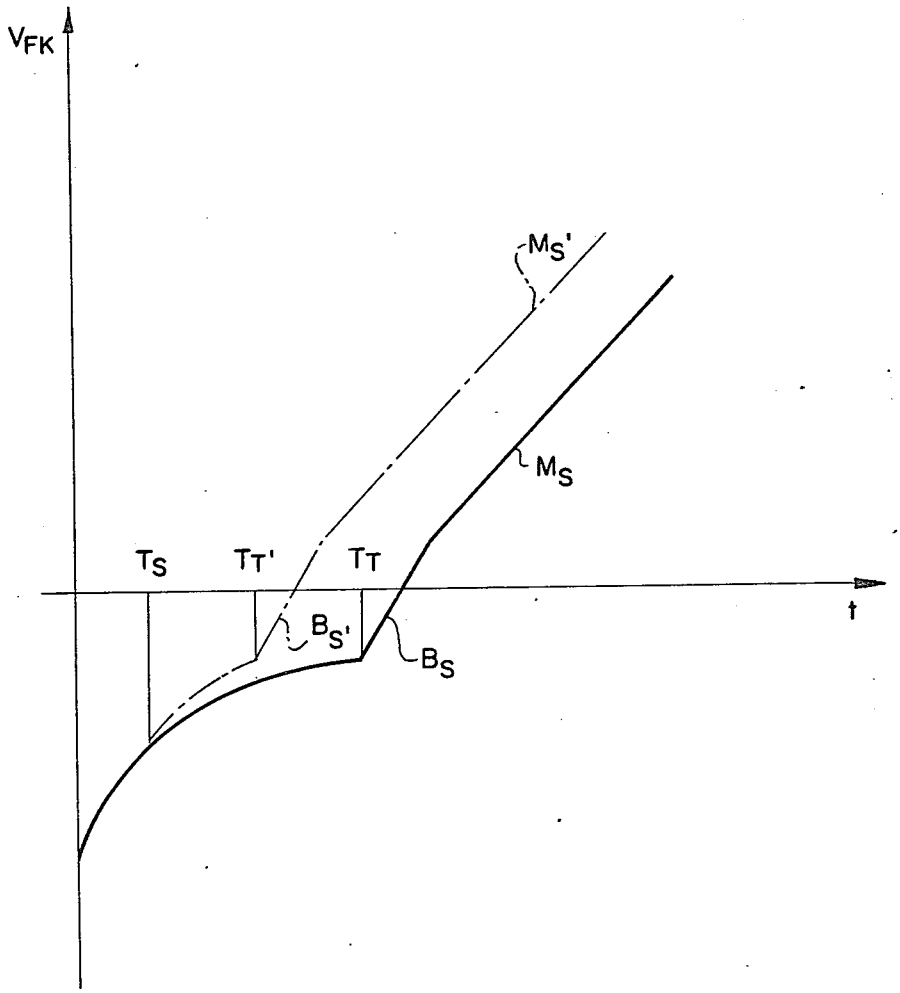
FIG. 8 illustrates - in the form of a diagram - the course of the flight speeds of the missile with respect to time.

According to FIG. 8, which illustrates in a diagram the speed ratios over the period off time t during the braking operation $V_{FK}$ is indicated therein as the resultant relative air velocity in dependence upon the time. Negative values of $V_{FK}$ signify an air flow against the missile from the rear and positive values of $V_{FK}$ indicate such flow from the front.

Figure 7:
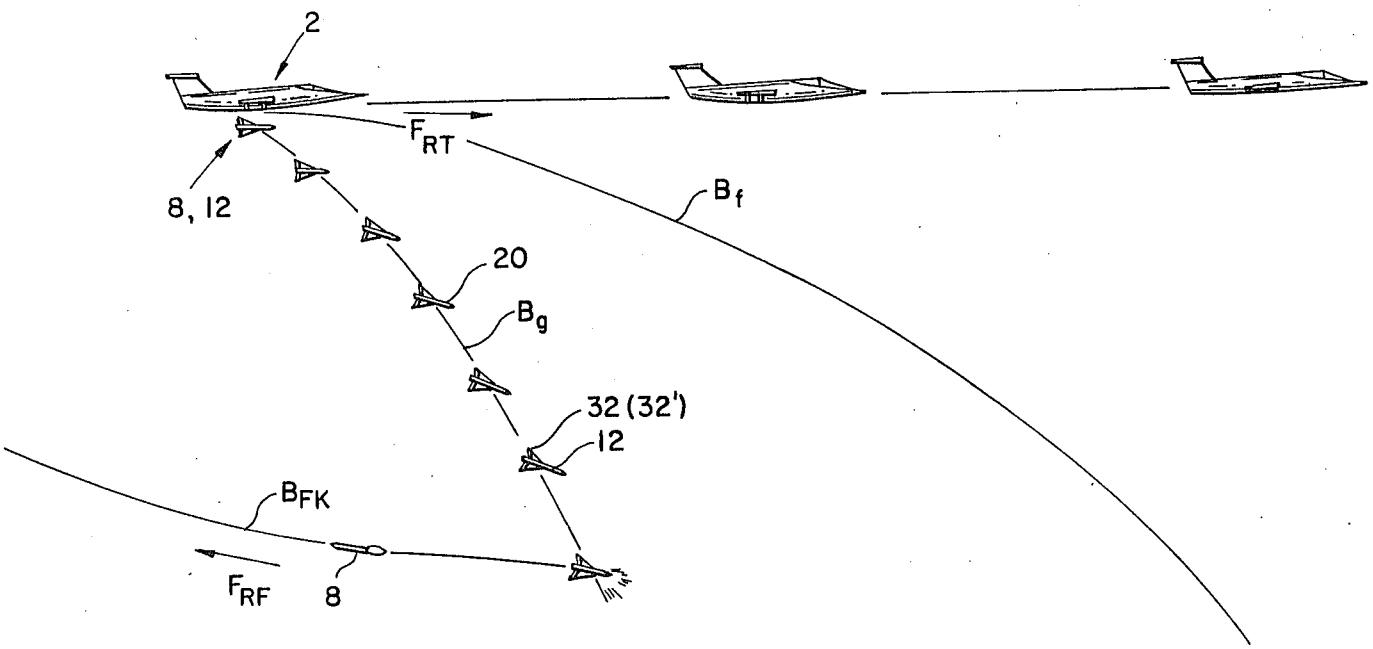
FIG. 7 is a schematic view of the flight directions and flight paths of the carrier airplane, the receiving container, and the missile.

Once the seeker or searching head 24 at the missile 8 has picked up a target, the receiving container 12 together with the missile 8 it carries is released from the carrier airplane 2, and thereupon the opening operation of the brake flaps 32 is initiated. $B_f$ in FIG. 7 indicates the flight path in an unbraked dropping of the missile 8, while $B_g$ indicates the flight path of the braked missile 8 with the receiving container 12, and $B_{FK}$ indicates the flight path of the missile 8 after leaving the receiving container 12. The braking flaps 32 are at that time lifted by means of springs (not shown) off of the receiving container 12 to such an extent that the dynamic pressure of the flow can be utilized for the complete automatic opening of the flaps 32.

The synchronous ring 40 in conjunction with the hold-back rods 36 serves for the synchronous opening of the brake flaps 32. The hydraulically-acting damping members 46 serve for damping the folding-out movement of the braking flaps. During the braking operation, the speed and the dynamic pressure are measured by means of the dynamic pressure measuring sonde 20 and, when the dynamic pressure of the flow admissible for the start of the missile 8 has been attained, i.e. at the time $T_T$ (FIG. 8), the propulsion unit of the missile 8 is ignited and the missile 8, equipped for example with a thrust vector control, is started. The missile 8 leaves the receiving container 12 in the direction $F_{RF}$ on the path $B_{FK}$ and has at that time initially still residual return flight speed $V_{FK}$ (FIG. 8). After the missile 8 leaves the container 12, the stabilizer surfaces 52 move into the operative position thereof. During the leaving of the missile from the container 12, the residual return flight speed $V_{FK}$ of the missile 8 is rapidly reduced and changes into a forward movement. The thrust vector control allows for a perfect guide of the missile 8 both during the return flight phase with a low dynamic flow pressure, and during the forward flight phase. In order to achieve a shortening of the braking phase, it is also possible to provide for the braking device operation in two stages according to FIG. 6.

According to FIG. 8, the second braking flap system with the braking flaps 32' is activated at the time $T_S$ when a specific braking delay has begun, and when the dynamic pressure has fallen below a specific value. The addition of a second flap system brings about an increase in resistance and an increased delay of the device 12, and thus allows for an earlier attainment of the admissible dynamic pressure for the start of the missile 8. By means of the second braking system 32' the starting time is shortened from $T_T$ to $T_T'$. The speed course has been identified, according to FIG. 8, with $B_S$ in the boost phase in which an increased thrust becomes effective, and with $M_S$ in the cruising phase for a propulsion unit having two thrust phases. The dash-dotted line indicates the shortening of the braking phase by means of the second brake system with the braking flaps 32' and the possibility to start the missile 8 already at the time $T_T'$. In this case, therefore, $B_S'$ is the boost phase with the use of a two-stage braking device 26, and accordingly $M_S'$ the coordinated cruising phase.

It will be obvious to those skilled in the art that many modifications may be made within the scope of the present invention without departing from the spirit thereof, and the invention includes all such modifications.

What is claimed is:

1. A device for starting a rocket-driven missile whose flight course is directed opposite the flight course of a carrier aircraft, which comprises aerodynamically-acting, concentrically-mounted, braking means mounted on receiving container means for said rocket-driven missile, said braking means being mounted on said container means in the area of the tip of a missile contained therein, and being adapted to be extended from a position of low resistance to a position of higher resistance, and means for detaching said container means together with said rocket-driven missile from said carrier aircraft.

2. A device for starting a rocket-driven missile whose flight course is directed opposite the flight course of a carrier aircraft, which comprises aerodynamically-acting, concentrically-mounted, braking means adapted to act upon said rocket-driven missile in the area of the tip thereof, said braking means including two sets of aerodynamically-acting braking flaps foldable from a position of low resistance into an extended position of higher resistance, means whereby said sets may be successively extended into the operative position thereof, said flaps having a symmetrical arrangement with respect to each other, and means for separating said braking means from said rocket-driven missile upon completion of the braking operation.

3. A device for starting a rocket-driven missile whose flight course is directed opposite the flight course of a carrier aircraft, which comprises aerodynamically-acting, concentrically-mounted, braking means mounted on said rocket-driven missile in the area of the tip thereof and being detachable therefrom, said braking means being adapted to be extended from a position of low resistance to a position of higher resistance, and means for separating said braking means from said rocket-driven missile upon completion of the braking operation.

* * * * *